US005280825A

United States Patent [19]

Cholet

[11] Patent Number: 5,280,825

[45] Date of Patent: Jan. 25, 1994

[54] DEVICE AND INSTALLATION FOR THE CLEANING OF DRAINS, PARTICULARLY IN A PETROLEUM PRODUCTION WELL

[75] Inventor: Henri Cholet, Le Pecq, France

[73] Assignee: Institut Francais du Petrole, Cedex, France

[21] Appl. No.: 902,584

[22] Filed: Jun. 22, 1992

[30] Foreign Application Priority Data

Jun. 21, 1991 [FR] France ..... 91 07638

[51] Int. Cl.[5] ..... E21B 33/00

[52] U.S. Cl. ..... 166/311

[58] Field of Search ..... 166/311, 312, 369, 372, 166/222, 223; 175/67

[56] References Cited

U.S. PATENT DOCUMENTS

| | | | |
|---|---|---|---|
| 4,285,402 | 8/1981 | Brieger | 166/311 |
| 4,671,359 | 6/1987 | Renfro | 166/312 |
| 4,744,420 | 5/1988 | Patterson et al. | 166/312 |
| 5,086,842 | 2/1992 | Cholet | 166/312 |

FOREIGN PATENT DOCUMENTS

| | | | |
|---|---|---|---|
| 417009A1 | 3/1991 | European Pat. Off. . | |
| 0848601 | 7/1981 | U.S.S.R. | 166/311 |

*Primary Examiner*—Thuy M. Bui

*Attorney, Agent, or Firm*—Antonelli, Terry, Stout & Kraus

[57] ABSTRACT

The invention relates to a device for cleaning a horizontal drain (10) adapted for being disposed at the end of two concentric pipe columns (14, 16). This device includes a body (20) provided with at least one cleaning fluid outlet port (38) and with at least one return port (30) for the fluid loaded with particles.

The outlet ports are directed towards the wall of the drain and located at a predetermined distance from the return ports.

The invention further relates to an installation for the cleaning of horizontal drains and to a method for implementing the installation.

18 Claims, 5 Drawing Sheets

DEVICE AND INSTALLATION FOR THE CLEANING OF DRAINS, PARTICULARLY IN A PETROLEUM PRODUCTION WELL

FIELD OF THE INVENTION

The present invention relates to devices and installations for cleaning horizontal drains in petroleum production wells.

BACKGROUND OF THE INVENTION

It is known that the placing of wells in production in sandy deposits, with the aid of horizontal or slightly sloping drains, results in the sand being carried by the fluid flowing from the deposit and results in large deposits of sand or other sediments, mainly in the horizontal part of the drains. This causes a considerable decrease in the production of the well and sometimes makes it impossible to introduce measuring or intervention tools down into the drain.

U.S. Pat. No. 4,744,420 describes a known device for cleaning such horizontal drains which includes, at the end of two concentric pipe columns, a body fitted with nozzles for projecting a cleaning fluid, this body delimiting a cleaning fluid feeding passage connected to said nozzles, as well as a passage for the return of this fluid loaded with solid particles of sand or other sediments, these two passages being respectively connected to one of the two pipes delimited by the two concentric pipe columns.

In this known device, the nozzles for projecting cleaning fluid are disposed at the end of the body and are orientated substantially parallel to the axis of the drain. Such a lay-out tends to expel in front of the device the sand and other sediments accumulated in the drain.

It is this particular problem which the invention proposes to resolve so as to carry out a more effective cleaning of such horizontal drains.

European Patent No. 417,009 mentions a known device including deflecting means adapted for directing the cleaning fluid jet coming out of a nozzle in the direction of the wall of the drain.

The deflector may however be a mechanically fragile part with certain dimensions of the device. Besides, the equipment does not allow the distance between the turbulence zone of the cleaning fluid at the outlet of the nozzle and the suction zone to be adjusted.

It has been established that adjusting this distance is important because it conditions the proper return circulation towards the sucking device of the fluid loaded with sediments. In fact, the purpose of the fluid spurting out of the outlet ports is to stir and to carry along the sediments towards the sucking device. To this effect, the outlet ports are disposed, with respect to the suction ports, in such a way that the stirring turbulences are sufficiently distant from the suction ports in order not to impede the direction of circulation of the fluid intended to carry along the sediments, and at the same time close enough for the suction effect to act effectively on the fluid loaded with sediments suspended by said turbulences.

The parameters acting upon this distance may be notably the available rate of circulation of the fluid, the mean viscosity of the fluid loaded with sediments, the diameter of the drain, the density of the sediments or the rheology of the cleaning fluid.

SUMMARY OF THE INVENTION

To this effect, the purpose of the invention is to provide a device for cleaning a horizontal drain or a slightly sloping drain adapted to be disposed at the lower end of two concentric pipe columns delimiting two pipes also concentric, this device comprising a body which is provided with at least one fluid outlet port and with at least one fluid return port, said body firstly delimiting a cleaning fluid feeding passage and secondly a return passage for the fluid loaded with solid particles, these two passages being intended to be respectively connected to the two pipes delimited by the pipe columns.

The outlet port is located at a predetermined distance from the return port and the outlet port is directed towards the wall of the drain.

The device may comprise means for adjusting the distance between the outlet and the return ports.

The outlet ports may be inclined at an angle ranging between 10° and 80° to the longitudinal axis of the body and in the direction of the return port.

The device may comprise three outlet ports distributed at 120° to the longitudinal axis of said body and located between the outlet port and the bottom of the drain.

The return port may open onto the periphery of the body.

The end of the body comprising the outler ports may be rotary.

The adjusting means may include a set of braces piled between the two ports.

In the device according to the invention, the fluid feeding passage may comprise from upstream to downstream inside the body a ring-shaped pipe, at least one radial passage and an axial pipe, and the return passage of the fluid loaded with particles comprises from downstream to upstream at least one pipe coming out of the body through the return port, one ring-shaped pipe encompassing a working fluid injector and an axial pipe.

The ring-shaped pipe and the axial pipe may form a venturi tube which, along with the injector, forms a sucking device.

The injector may be fed with working fluid from the radial passage and the axial pipe, the fluid flow rate being distributed inside the axial pipe into two opposing flows respectively directed towards the outlet ports and the injector.

The passage section of the injector may be greater than the sum of the sections of the outlet ports.

The body of the device may be connected at the rear or upstream part thereof to a connector comprising two sets of pipes which communicate respectively an upstream axial pipe with a downstream ring-shaped pipe and an upstream ring-shaped pipe with a downstream axial pipe.

According to the invention, the device may have one of the following two configurations:

fixed onto the outer concentric pipe column and comprising connecting means operated from the surface between the inner pipe and said device, of an outside diameter smaller than the inside diameter of said outer concentric pipe column and the body co-operating with the end of the outer concentric pipe column through sealing and axial stop means.

The invention also relates to an installation for cleaning horizontal or slightly sloping drains, notably in a petroleum production well, comprising: two concentric pipe columns delimiting two pipes, also concentric; a device for projecting a cleaning fluid and means for discharging the loaded fluid, respectively connected to one of said concentric pipes. The device of the installation is such as that defined above in any one of the configurations.

In the installation, the means for feeding the cleaning fluid may be connected to the pipe delimited by the inner pipe column.

The installation may include a connection box connected to the two concentric pipe columns and comprising notably a sealing means between the outside of said box and the walls of the well, said box being connected to the surface through a maneuvering tube, said sealing means and said maneuvering tube delimiting an inner pipe and a ring-shaped pipe. Said box is adapted for communicating either said pipe of the inner pipe column with the inner pipe of the maneuvering tube, the annulus of the maneuvering tube being connected to the other pipe of the concentric pipe columns, or said pipe of the inner pipe column with the annulus of the maneuvering tube, the inside of the maneuvering tube being connected to the other pipe of the concentric pipe columns.

The invention further provides a method for implementing the installation comprising the following stages:

taking down into the well a length of outer concentric pipe column with or without the device fixed at the end thereof, said length being adapted to the length of cleaning of the drain, taking down into said outer pipe column the other concentric pipe column and either connecting it to said device when the latter is taken down while being fixed to the outer pipe column, or until said device co-operates with the end of said outer pipe column through the sealing and stop means when the device is fixed to said other pipe column, fixing onto said concentric pipe columns the connection box, taking down the assembly comprising the device, the concentric pipe columns and the connection box while adding maneuvering tubes above said box, cleaning said drain by injecting a fluid through pumping into the inner pipe of the maneuvering tubes or into the annulus of the maneuvering tubes.

BRIEF DESCRIPTION OF THE DRAWINGS

Other features and advantages of the present invention will be clear from reading the description hereafter of particular, non limitative examples, with reference to the accompanying drawings in which.

DESCRIPTION OF THE PREFERRED EMBODIMENTS

Figure 1:
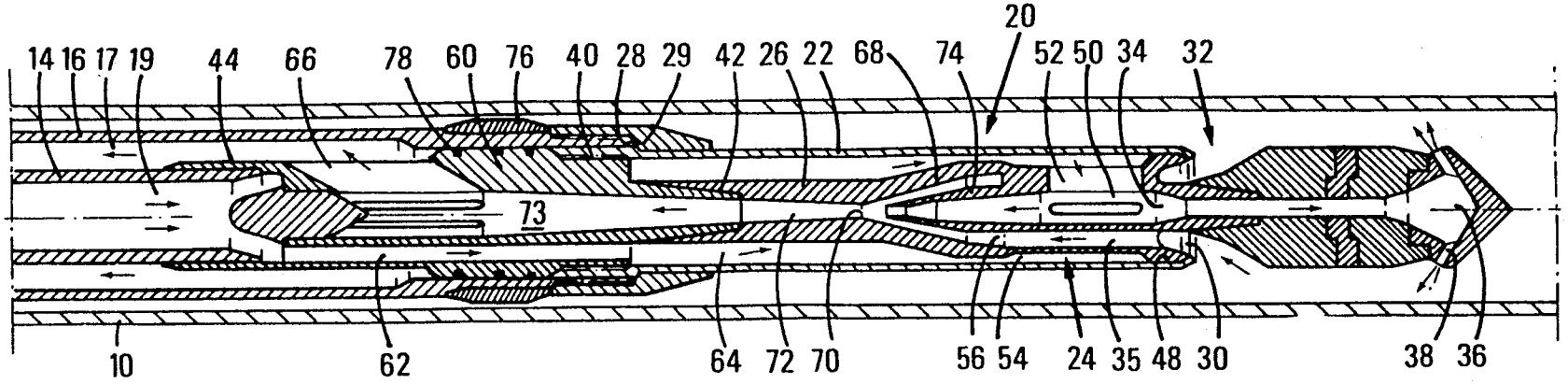
FIG. 1 is a longitudinal cutaway view of a device according to the invention.
Figure 4A:
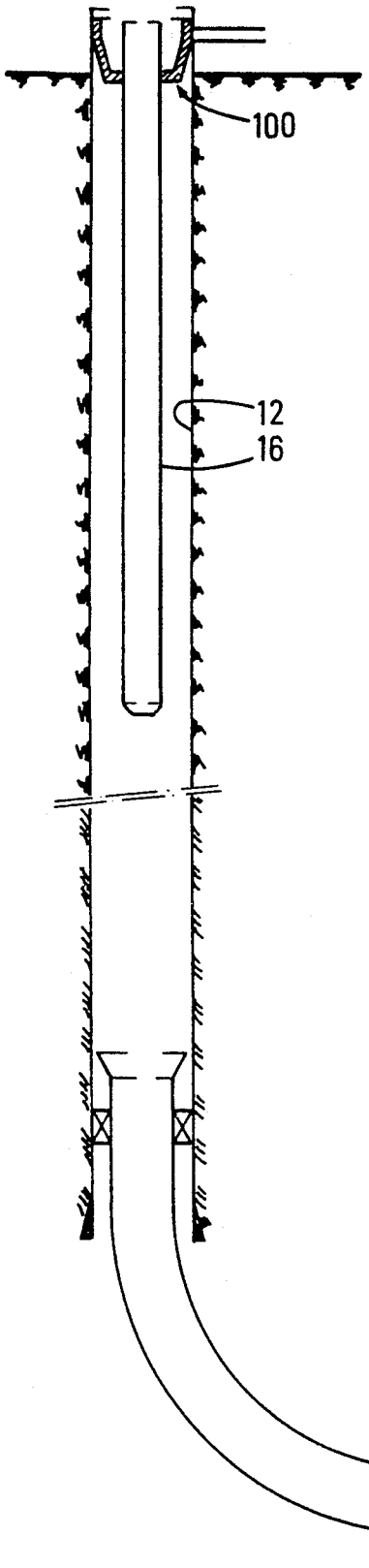
FIGS. 4A, 4B, 4C and 4D show the implementation of the installation.

FIG. 1 shows a horizontal or substantially horizontal drain section 10 connected to a main pipe column 12 (FIG. 4A).

Two concentric pipe columns 14 and 16 delimiting between them a ring-shaped pipe 17 are arranged in this drain, while the inner pipe column delimits an axial pipe 19. The downstream end of inner pipe column 14 is standing back with respect to the downstream end of the outer pipe column, the device according to the invention being disposed between these two ends.

This device includes a body 20 comprising several parts, in this case three, achieved and arranged so as to carry out several functions which will be described in a more detailed way hereafter. These three parts are: an outer part 22, a front central part 24 and a rear central part 26.

The outer part 22 is received in a sheath 28 and rests longitudinally on a thrust 29 bonded to this sheath. The latter is fixed by any suitable well-known means to the end of pipe column 16, the fixing device being not shown here for reasons for readability of the figure. The fixing means may for example be a threaded connection.

This outer part is hollow and comprises at the end thereof directed towards the downstream of the device a head 32 which is pierced with an axial pipe 34 and three pipes 35 separated from pipe 34 and which open into head 32 through ports 30. The pipes 35 are arranged at 120° to each other. According to the size of the device, a larger number of such pipes may be provided, for example 6. Pipe 34 communicates with a cavity 36 extending from fluid projecting ports 38.

At the rear of pipe 34, the head of the outer part 22 of body 20 comprises a housing 48 receiving the central part 24 of the body which delimits firstly a central pipe 50 which forms the continuation of pipe 34, at least one radial passage 52 communicating this central pipe with a ring-shaped pipe 54 delimited between the central parts of the body and the outer part, and at least one longitudinal pipe 56 which forms part of the return passage of the fluid loaded with solid particles. In the embodiment shown, three pipes 56 are provided in the prolongation of the three pipes 35.

In going back up to the rear, the outer part of the body, connected to a connector 60 by a thread 40, exhibits a tubular shape. The rear central part is connected to connector 60 by thread 42.

Connector 60 is connected to pipe column 14 by a thread 44.

This connector 60 comprises two sets of pipes:

a first set of three pipes 62 which ensure communication between the inside 19 of pipe column 14 and a ring-shaped pipe 64 delimited between the outer part of the body and the rear central part 26 of this body, a second set of three pipes 66 ensuring communication between the annular space 17 delimited between the two pipe columns, and the axial pipe 73 of connector 60.

Part 26 forms a venturi tube and delimits a converging cone 68, a neck 70 and then a diverging cone 72 so as to form with an injector 74 fixed in the central body a sucking device whose function will be specified hereafter.

The rear central part 26 is also fixed to the front central part 24 of the body, but the fixing means thereof is not shown in FIG. 1.

The outer pipe column is kept centered in drain 10 through a well-known centering device 76.

Besides, sealing means 78 are interposed between connector 60 and outer pipe column 16.

In this construction, the outside diameter of the device is smaller than the inside diameter of outer pipe column 16. The device may be taken down inside the outer pipe column by manoeuvering the inner concentric pipe column which said device is fastened to through connector 60. The device is stopped by thrust 29 and the sealing of ring-shaped pipe 17 is completed by sealing means 78.

Figure 2:
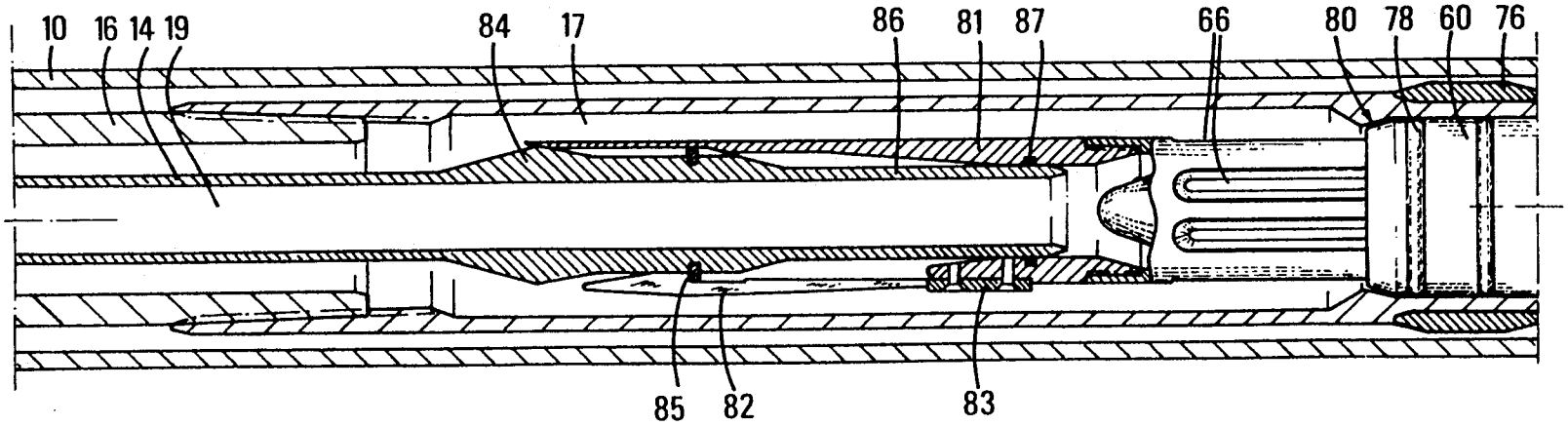
FIG. 2 is an embodiment variant of the device.

A construction variant is proposed and shown in FIG. 2 in the case where it is not possible to manoeuver the device in the outer pipe column, particularly because the inside diameter of the outer pipe column is small.

FIG. 2 shows the rear part of the connector 60 of the device, the front part which is not shown in this figure being identical to that of FIG. 1.

The rear or upstream part of connector 60 abuts on a shoulder 80 and is thus immobilized in translation through the interaction of the two thrusts 80 and 29.

A guide bushing 81 comprising at least two longitudinal grooves in which locking fingers 82 are disposed is fastened to the upstream end of connector 60. The fixing means 83 of these fingers is adapted so that they may deform radially so as to hook pipe column 14 at the end thereof comprising a latching connection 84. Latching connection 84 comprises a holding part 85 adapted for co-operating with the locking fingers, and a downstream extension 86 adapted for co-operating with the sealing means 87 borne by the inside of bushing 81.

The embodiment of FIG. 2 allows the device to be taken down at the same time as outer pipe column 16, then inner pipe column 14, fitted with connection 84, to be taken down concentrically, and inner pipe column 14 to be connected to the device so as to delimit pipes 17 and 19.

Figure 3:
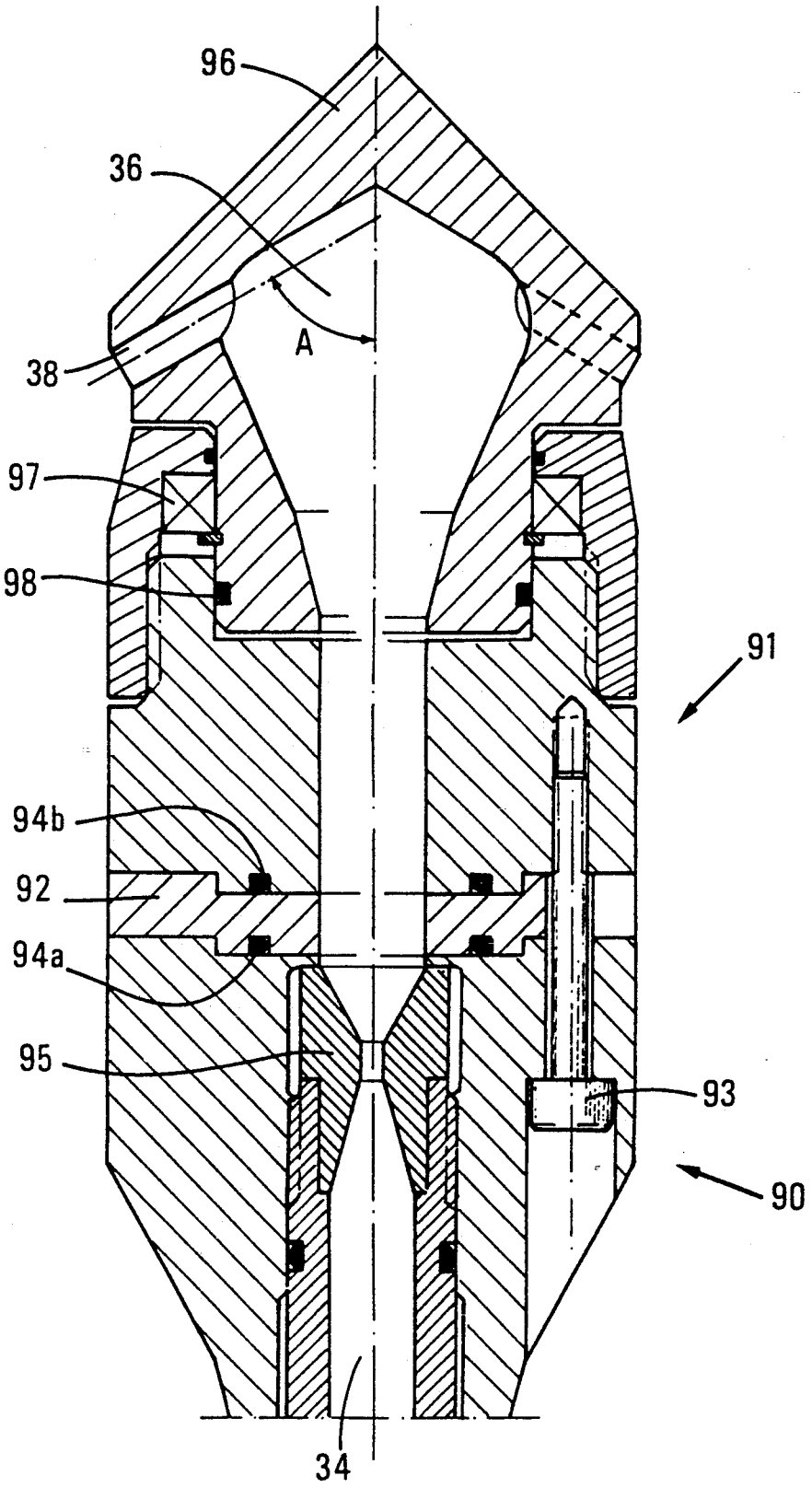
FIG. 3 is a detailed view of the end of the body and the two ports.

FIG. 3 shows an enlarged view of an embodiment of the head 32 of the outer part 22 of body 20.

The head comprises two parts 90 and 91 bonded to one another by screws 93 distributed on the circumference. A brace 92 is interposed between the two parts. The brace is pierced in the center thereof to allow pipe 34 to extend towards cavity 36. Filler joints 94*a* and 94*b* complete the lay-out of this system for adjusting the distance between outlet ports 38 and return ports 30. In fact, one set of braces is sufficient for varying this distance by adding or removing a determined thickness of braces. It may also be necessary to have a set of screws 93 of various lengths.

The fitting of a nozzle 95 on axial pipe 34 is shown in FIG. 3. The function of this nozzle will be described hereafter, but the nozzle is not indispensable within the scope of this invention. It is the same for cavity 36, which represents a widening of pipe 34 which is not essential, particularly when there is no nozzle 95.

The ports 38 are pierced in the end part 96, the direction of these piercings being achieved in the direction of the wall of drain 10 and preferably inclined towards the upstream part of the device or towards the fluid return ports 30. This angle A may range between 10° and 80°, but it will preferably be 60°. These ports 38 may be the nozzle ports mounted on head 96 as in the lay-out described above without departing from the scope of this invention. In this case, it will be possible to change the diameter of the fluid outlet ports without changing the end 96 of head 32.

The end 96 bearing ports 38 is preferably stationary with respect to the device, but it may be rotary through the mounting shown in FIG. 3. The head 96 freely rotates by means of bearing 97, the sealing being provided by means 98. The setting into rotation may notably be obtained by means of the construction in which the axes of the ports are not concurrent on the longitudinal axis of the device.

The device functions as follows:

The inner pipe column 14 is fed with fluid, in this case water, from the surface. This fluid coming into connector 60 passes from the axial pipe 19 through pipes 62 towards the ring-shaped pipe 64 delimited between the central and outer parts of the body, so as to finally arrive at the radial passage 52.

Once it has reached axial pipe 50, the working fluid is divided into two flows, one directed towards ports 38 and the other one towards injector 74. The respective sections of ports 38 or of nozzle 95 and of the injector are selected so as to obtain a determined distribution of the flow rate, which may be for example 3/5th of the incident flow rate in the direction of the injector and 2/5th in the direction of ports 38.

The fluid jets emitted through ports 38 are directed towards the wall of the drain and cause an effective agitation of the solid particles of sand or other sediments accumulated inside the drain. The fluid loaded with these particles is sucked at the level of ports 30 through pipes 35, this suction effect being caused in venturi tube 68-72 by the second flow of working liquid emitted by injector 74.

The suction ports 30 open substantially onto the periphery of the body of the device, being thus located as close as possible to the wall of the drain where the loaded fluid coming from the outlet ports preferably circulates. The closest the suction ports are to the wall of the drain, the more efficient the cleaning of the drain will be. The sufficient distance between ports 38 and 30 ensures that the directions of the velocities of the solid particles are substantially unidirectional and parallel to the longitudinal axis in the vicinity of openings 30, which favours the inflow of the particles into channels 35 through ports 30. The determination of this distance takes into account the energy of the turbulences generated through ports 38 and the section of the annular space between head 32 and the walls of the drain.

The working fluid and the liquid loaded with particles mix together in the part 70, 72 of the body and are directed towards the surface in traversing connector 60 through pipes 66 and by passing through the ring-shaped pipe 17 delimited between the two pipe columns.

The distance between the two outlet and return ports will be adjusted so as to adapt the device to the cleaning conditions of a particular site, notably by taking into account the pumping available on the worksite and the inside diameter of the drain.

More generally, the device may be embodied in a larger number of variants, both as regards the embodiment of parts composing it and as regards the number and disposition of the various cleaning fluid intake and return pipes.

In the preferred embodiment described, the fluid loaded with solid particles flows towards the surface by mans of ring-shaped pipe 17, while the working fluid is injected through axial pipe 19. The reverse may be achieved without departing from the scope of this invention, provided that the velocity of the loaded fluid is sufficient for the sedimentation of the particles to be avoided in the pipe. Besides, the loaded fluid will be preferably caused to flow back through the pipe having the largest section so as to limit the pressure drops, downstream from the venturi tube, which limit the suction effect.

There now follows a description in relation to the other figures of an installation integrating the device described above, as well as an operational mode.

FIG. 4A shows a main pipe column 12 which extends from the surface and which comprises a vertical part, then a curved part, so as to be extended by the substantially horizontal drain 10.

Firstly, the outer pipe column 16 comprising at the end thereof the sheath 28 and the centering device 76 is inserted into this main pipe column.

Two configurations are possible, according to the inside diameter of pipe column 16:

1) the device is fixed to the end of pipe column 16 according to the variant of FIG. 2, the device is then taken down with pipe column 16,
2) pipe column 16 comprises at the end thereof sheath 28 only, according to the configuration of FIG. 1.

The pipe column 14 bearing at the end thereof connection 84 according to configuration 2, or the device proper which is disposed in sheath 28 according to configuration 1, is then inserted into pipe column 16.

As it is known in the technique, the pipe columns 14 and 16 may be formed either of rigid tubes screwed together or of continuous elements unwound from the surface.

The installation may, of course, be completed by connecting the inner pipe column to a pump supplying water under pressure, and by connecting the outer pipe column to well-known means for extracting the liquid loaded with particles. These well-known means may notably be rigid tube elements comprising two concentric tubes, the pipe of the inner tube being connected to pipe 19 and the annulus between the inner tube and the outer tube being connected to pipe 17. The progress of the cleaning is achieved by adding these elements to one another.

It is also possible, as described in document EP 417,009, to use a device comprising two parallel tubes in well 12 and coming up to the surface.

Figure 5B:
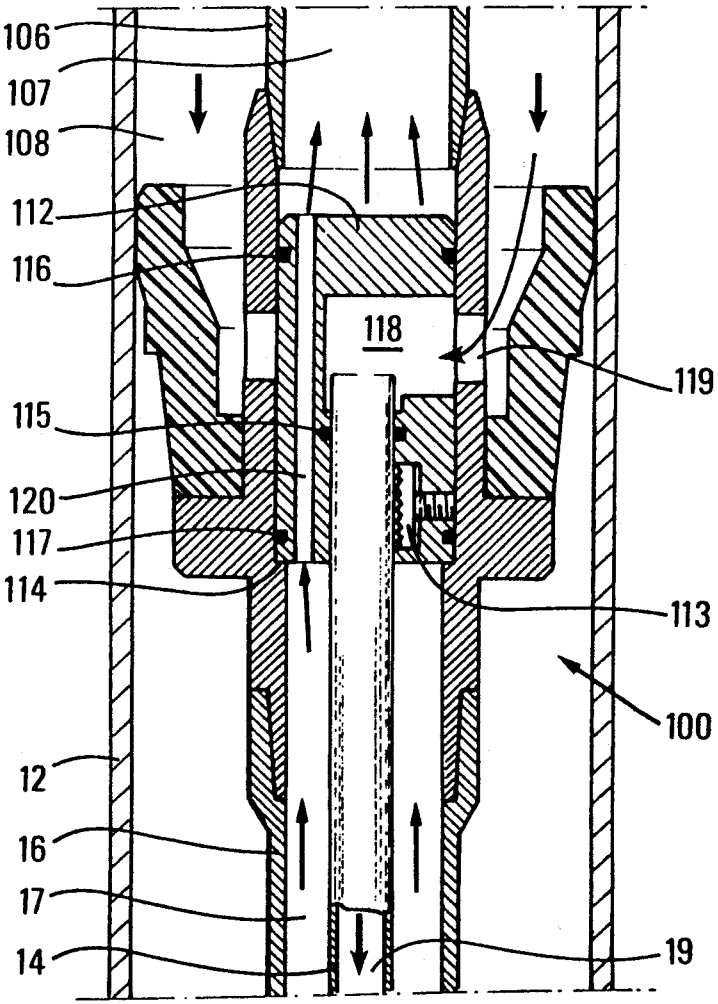
FIGS. 5A and 5B show embodiments of the connection box.
Figure 5A:
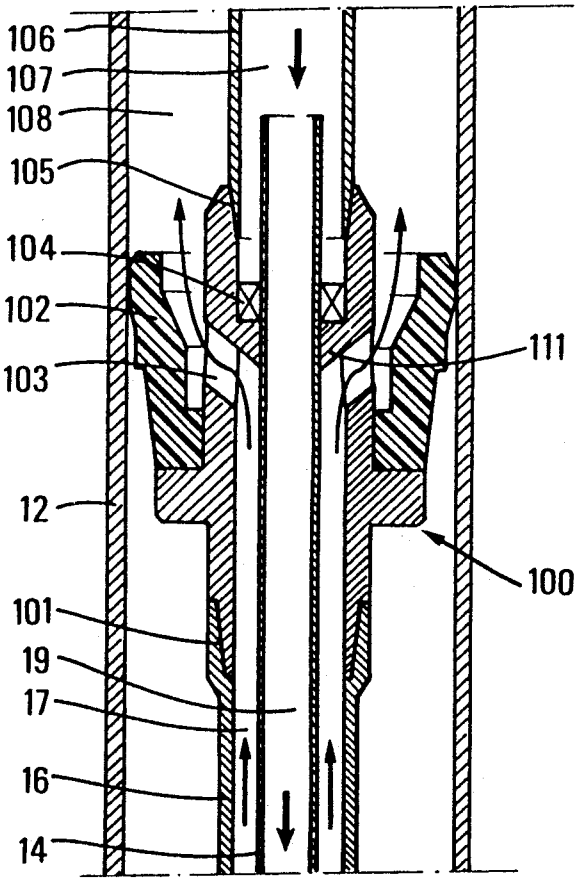

However, according to the installation of the invention, a connection box 100 shown in FIG. 5A or 5B is used. According to FIG. 4A, the connection box is mounted at the surface on the end of pipe column 16. Pipe column 14 is thereafter taken down according to any one of configurations 1 or 2. When the device rests against thrust 29, or when pipe column 14 is locked in bushing 81, the end of pipe column 14 is fixed into connection box 100.

The two variants of the box 100 will be described more precisely hereafter, but in order to follow the sequence of the stages of the operational mode, it will be enough to note that the box comprises a sealing cup 102 which provides a seal between the body of the box and the main pipe column 12, that the upper part of the box comprises a thread 105 adapted for connecting a maneuvering tube 106 and that it is adapted for communicating pipe 19 with the inner pipe 107 of the maneuvering tube and the pipe 17 with the ring-shaped pipe 108 between the maneuvering tube and the well 12, or conversely in the second variant of FIG. 6.

Figure 4B:
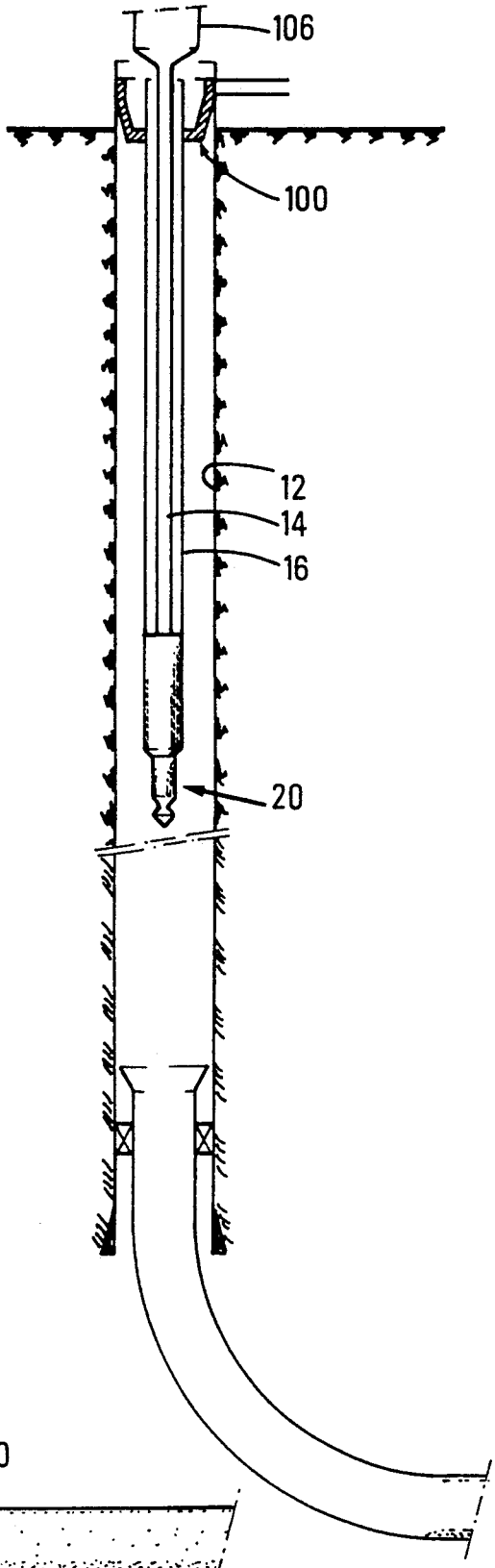

FIG. 4B thus shows the two pipe columns 14 and 16 connected to box 100 and to which a first section of a manoeuvering tube 106 is connected. The body 20 of the device sticks out from pipe column 16.

The device is taken down to the drain to be cleaned by further assembling manoeuvering tubes.

Figure 4D:
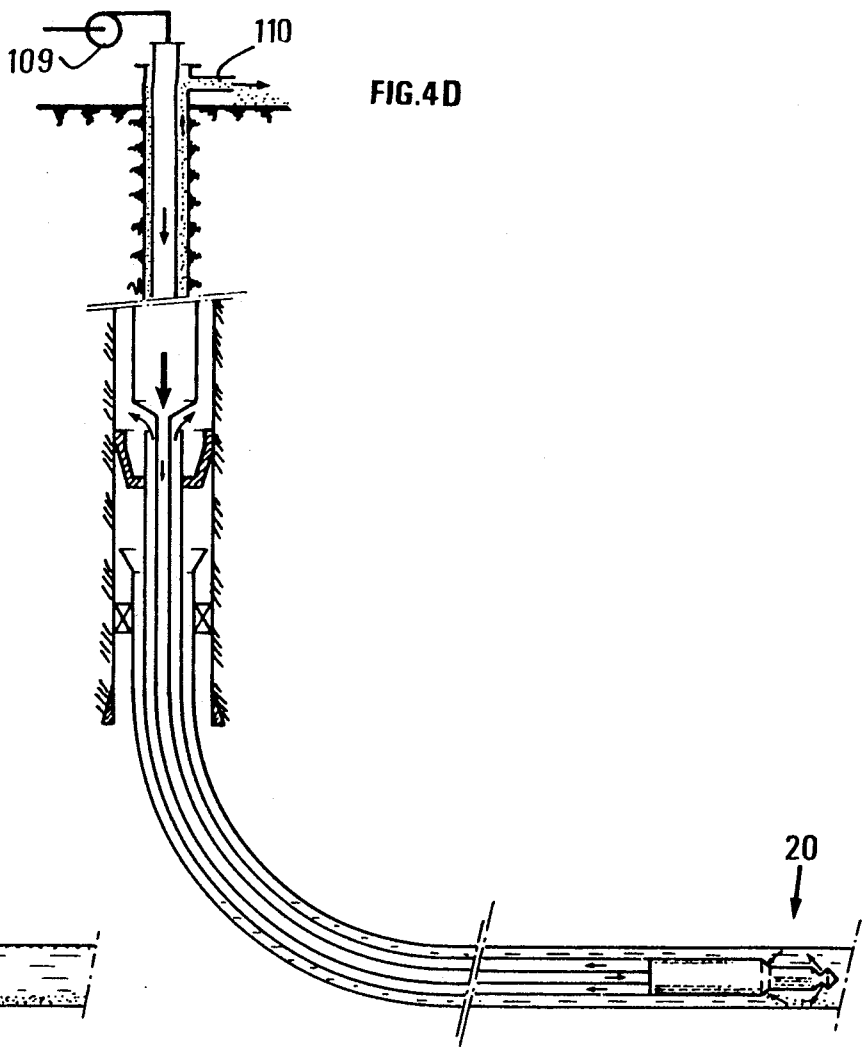
Figure 4C:
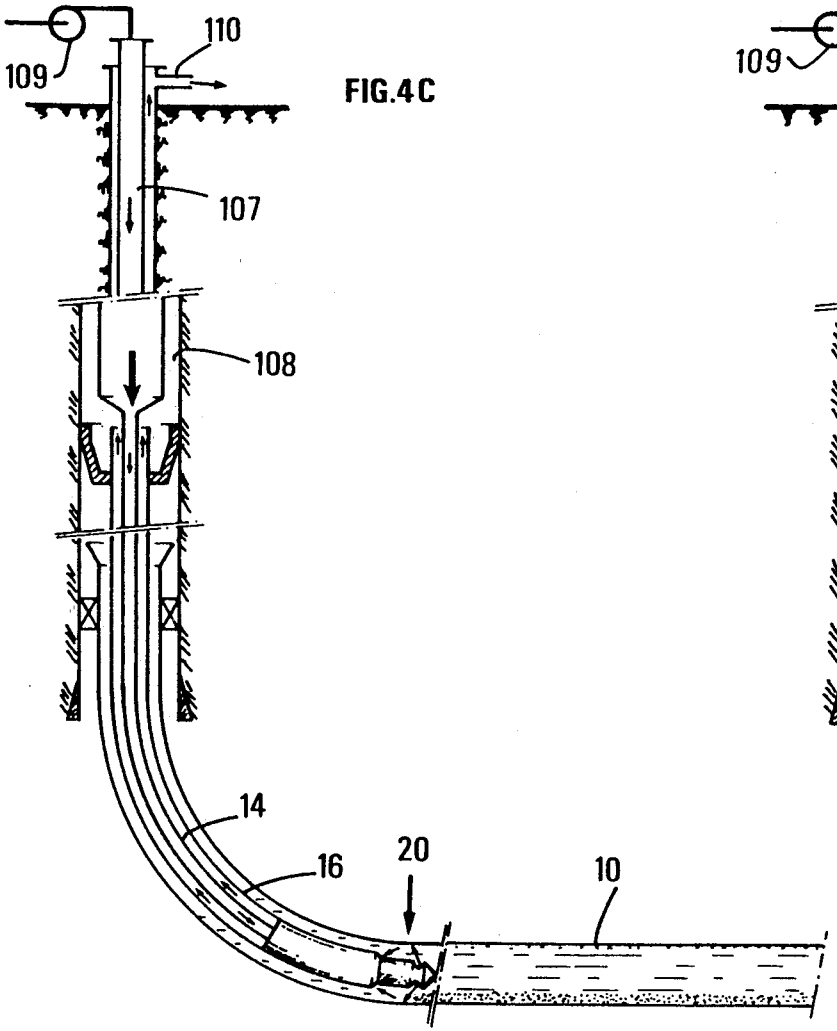

FIG. 4C shows the beginning of the cleaning operation, after the inside 107 of the tubes 106 has been connected to a circulating pump 109, the return circulation of the fluid loaded with sediment flowing through annulus 108 so as to be collected through chute 110 towards a separation installation.

FIG. 4D shows the progress of the cleaning.

When the cleaning operation is over, the device is taken up by disassembling the manoeuvering tubes 106, by taking up pipe column 14, either with the device fastened to the end thereof according to configuration 2, or according to configuration 1 after the rupture of holding part 85, notably by traction from pipe column 14. The connection box and then pipe columns 16 are dismounted thereafter.

FIG. 5A shows the connection box 100 screwed on pipe column 16 by a connection 101. The box comprises a sealing cup 102, for example a tester-cup manufactured by Cameron Iron Works. Ports 103 communicate the inside of the box with the outside, above cup 102. Pipe column 14 is held up by a latching system 104 locked in translation downwards by a necking 111. Latching system 104 also comprises a sealing means for isolating the annulus 17 from the inside 107 of the manoeuvering tube. Fastening the latching system 104 is achieved over a length of pipe column 14 located above the box, then pipe column 14 is taken down so as to be suspended by means of the system 104 stopped by necking 111.

FIG. 5B shows a varient of the box allowing pipe 19 to be connected to ring-shaped pipe 108 and ring-shaped pipe 17 to the axial pipe 107 of manoeuvering tube 106. The end fixing devices 101 and 105, as well as cup 102, may be common to the two variants. A suspension part 112 is fixed to the end of pipe column 14 through a latching system 113 comprising a set of jaws tightened by radial screws on pipe column 14 and a packer 115 on pipe column 14. This part 112 is locked downwards by necking 114. In this position, the joints 117 and 116 borne by part 112 delimit the communications of the various pipes. A cavity 118 of part 112 co-operates with port 119 so as to communicate pipe 19 with pipe 108. Pipes 120 pierced longitudinally with respect to part 112 communicate pipe 17 with axial pipe 107.

Using one or the other of the versions of box 100 will be notably conditioned by the upflow velocity of the fluid loaded with solid particles. In fact, it will be possible in certain cases to adjust this velocity by using manoeuvering tubes of a diameter large enough to decrease the section of annulus 108 and thereby to increase the upflow velocity of the fluid. When this is not possible, notably for reasons of weight or size, the return fluid will flow back through the inside of the manoeuvering tube.

In this case, pumping is required in annulus 108 and an annular sealing means such as a BOP is needed at the surface.

I claim:

1. A device for cleaning a horizontal or a slightly sloping drain adapted to be disposed at the end of two concentric pipe columns delimiting two pipes, also concentric, said device comprising a body which is provided with at least one fluid outlet port and with at least one fluid return port, said body delimiting firstly a cleaning fluid feeding passage and secondly a return passage for the fluid loaded with solid particles, said two passages being intended to be respectively connected to the two pipes delimited by the pipe columns, wherein the outlet port is directed towards a wall of the drain and wherein the return port is located at a predetermined distance from the outlet port.

2. A device as claimed in claim 1, comprising means for adjusting the distance between the outlet and the return posts.

3. A device as claimed in claim 1, wherein the outlet ports are inclined at an angle ranging between 10° and 80° to a longitudinal axis of the body and in the direction of the return port.

4. A device as claimed in claim 1, comprising three outlet ports distributed at 120° to a longitudinal axis of said body and located between the return port and bottom of the drain.

5. A device as claimed in claim 1, wherein the return port opens onto a periphery of the body.

6. A device as claimed in claim 4, wherein an end of the body comprising outlet ports is rotary.

7. A device as claimed in claim 2, wherein the adjusting means comprise a set of braces piled between the two ports.

8. A device as claimed in claim 1, wherein the fluid feeding passage comprises, from upstream to downstream, in the body a ring-shaped pipe, at least one radial passage and an axial pipe, and the return passage of the fluid loaded with particles comprises, from downstream to upstream, at least one pipe coming out of the body through the return port, a ring-shaped pipe encompassing a working fluid injector and an axial pipe.

9. A device as claimed in claim 8, wherein the ring-shaped pipe and the axial pipe form a venturi tube which, together with the injector, forms a sucking device.

10. A device as claimed in claim 9, wherein the injector is fed with working fluid from the radial passage and the axial pipe, the fluid flow rate being distributed in the axial pipe into two opposing flows respectively directed towards outlet ports and towards the injector.

11. A device as claimed in claim 10, wherein the passage section of the injector is greater than the sum of the sections of the outlet ports.

12. A device as claimed in claim 8, wherein the body is connected at the rear or upstream part thereof to a connector comprising two sets of pipes which respectively communicate an upstream axial pipe with a downstream ring-shaped pipe and an upstream ring-shaped pipe with a downstream axial pipe.

13. A device as claimed in claim 12, characterized in that it is fixed to the outer concentric pipe column and in that it comprises connecting means operated from the surface between the inner pipe column and said device.

14. A device as claimed in claim 12, wherein an outside diameter thereof is smaller than an inside diameter of said outer concentric pipe column and wherein the body co-operates with an end of the outer concentric pipe column through sealing and axial stop means.

15. An installation for cleaning horizontal or slightly sloping drains in a petroleum production well, comprising two concentric pipe columns delimiting two pipes, also concentric; a device for projecting a cleaning fluid and means for discharging the loaded fluid, respectively connected to one of said concentric pipes, wherein the device is defined in claim 1.

16. An installation as claimed in claim 15, wherein the cleaning fluid feeding means are connected to the pipe delimited by the inner pipe column.

17. An installation as claimed in claim 15 or claim 16, further comprising a connection box connected to the two concentric pipe columns and including a sealing means between outside of said box and walls of the well, said box being connected to the surface through a maneuvering tube, said sealing means and said maneuvering tube delimiting an inner pipe and a ring-shaped pipe, wherein said box is adapted to communicate either said pipe of the inner pipe column with the inner pipe of the maneuvering tube, the ring-shaped pipe of the maneuvering tube being connected to the other pipe of the concentric pipe columns, or said pipe of the inner pipe column with the ring-shaped pipe of the maneuvering tube, the inner pipe of the maneuvering tube being connected to the outer pipe of the concentric pipe columns.

18. A method for cleaning horizontal or slightly sloping drains in a petroleum well which comprises the following stages:

taking down into the well a length of an outer pipe column with or without a device fixed to the end thereof, said length being adapted to the length of cleaning of the drain, said device being adapted to be disposed at the ends of the two concentric pipe columns delimiting two concentric pipes comprising a body which is provided with at least one fluid outlet port and with at least one fluid return port, said body delimiting firstly a cleaning fluid feeding passage and secondly a return passage for the fluid loaded with solid particles, said two passages being intended to be respectively connected to the two pipes delimited by the two concentric pipe columns, wherein the outlet port is directed towards a wall of the drain and wherein the return port is located at a predetermined distance from the outlet port;

taking down into said outer concentric pipe column, the other concentric pipe column and connecting said outer concentric pipe column either on said device when the device is taken down while fixed to the outer pipe column or until said device cooperates with the end of said outer pipe column through a sealing and stop means, when the device is fixed to said other pipe column;

fixing onto said concentric pipe columns, a connection box;

taking down the assembly comprising the device, the concentric pipe columns and the connection box by adding maneuvering tubes above said box; and cleaning the drain by injecting a fluid into device via an inner pipe of the maneuvering tubes or into the device via a ring-shaped pipe defined by the sealing means and the maneuvering tubes.

* * * * *